US006652046B2

(12) United States Patent
Christner

(10) Patent No.: US 6,652,046 B2
(45) Date of Patent: Nov. 25, 2003

(54) LOUDSPEAKER BOX ARRANGEMENT AND METHOD FOR THE POSITIONAL ADJUSTMENT OF INDIVIDUAL LOUDSPEAKER BOXES THEREIN

(75) Inventor: Matthias Christner, Reutlingen (DE)

(73) Assignee: D & B Audiotechnik AG (DE)

( * ) Notice: Subject to any disclaimer, the term of this patent is extended or adjusted under 35 U.S.C. 154(b) by 81 days.

(21) Appl. No.: 09/930,731

(22) Filed: Aug. 15, 2001

(65) Prior Publication Data

US 2002/0121847 A1 Sep. 5, 2002

(30) Foreign Application Priority Data

Aug. 16, 2000 (DE) ..... 100 39 740

(51) Int. Cl.[7] ..... A47F 5/08
(52) U.S. Cl. ..... 312/111
(58) Field of Search ..... 312/107, 108, 312/111, 201, 202, 319.5–319.8; 248/324; 181/150, 199, 148; 381/188, 205, 87, 88, 90; 52/39; 211/118

(56) References Cited

U.S. PATENT DOCUMENTS 4,660,728 A * 4/1987 Martin ..... 211/118
4,757,544 A * 7/1988 Guy ..... 381/387
5,537,127 A * 7/1996 Jingu ..... 345/1.3
5,602,366 A * 2/1997 Whelan et al. ..... 181/144
5,758,852 A * 6/1998 Martin ..... 248/282.1
5,819,959 A * 10/1998 Martin ..... 211/118
5,926,153 A * 7/1999 Ohishi et al. ..... 345/1.1

FOREIGN PATENT DOCUMENTS

DE 3538312 5/1987
DE 29618829 4/1998

* cited by examiner

*Primary Examiner*—Janet M. Wilkens
(74) *Attorney, Agent, or Firm*—Ostrolenk, Faber, Gerb & Soffen, LLP

(57) ABSTRACT

A loudspeaker box arrangement has a plurality of loudspeaker boxes. Adjacent boxes are actively connected to one another by connecting elements in a positionally adjustable manner. Adjacent boxes are pivotally connected at their front sides and joined by the connecting elements at their rear sides for adjusting the pivot angle between boxes. The connecting elements are automatically adjustable as to angle and/or length by a control unit for achieving the individual positional adjustment of a particular loudspeaker box.

8 Claims, 3 Drawing Sheets

LOUDSPEAKER BOX ARRANGEMENT AND METHOD FOR THE POSITIONAL ADJUSTMENT OF INDIVIDUAL LOUDSPEAKER BOXES THEREIN

BACKGROUND OF THE INVENTION

The invention relates to a loudspeaker box arrangement having a plurality of loudspeaker boxes, which are actively connected to one another by means of connecting elements in a positionally adjustable manner. The invention further relates to a method for positionally adjusting individual loudspeaker boxes within a loudspeaker box arrangement, wherein the boxes are actively connected to one another by means of connecting elements.

Loudspeaker box arrangements and methods for the positional adjustment of individual loudspeaker boxes therein are known. In such arrangements, the loudspeaker boxes can be actively connected to one another in such a way that they jointly form a loudspeaker box column, in which a plurality of loudspeaker boxes are disposed substantially vertically one above the other. The loudspeaker boxes are actively connected to one another by mechanical, but hand operated connecting elements, particularly in the form of chains, belts and hooks. This connection is done in a preassembly operation. As a result, the speaker boxes assume a particular orientation relative to one another in their operating positions. The orientation of the individual loudspeaker boxes relative to one another within a box column is set before assumption of their operating positions using a suitable lengthwise setting of the connecting chains or the connecting belts, which are especially located at the rear side of the box column. For example, loudspeaker boxes of trapezoidal lengthwise section can be preassembled at their rear sides between neighboring loudspeaker boxes, by determining a suitable connecting length of the respective connecting chains and/or connecting belts. After subsequent fixing of the boxes to a stationary suspension device or retaining device to form a substantially vertical loudspeaker box column (operating position), the boxes are oriented at particular angles of incidence relative to one another. The orientation of the loudspeaker boxes relative to one another is thus defined during the preassembly of the corresponding loudspeaker box column and, disadvantageously, can be changed again only with a large expenditure of time and assembly effort.

SUMMARY OF THE INVENTION

It is an object of the invention to provide a loudspeaker box arrangement and a method of the type specified above which, in a rapid, reliable and precise manner, permit orientation of the loudspeaker boxes relative to one another even when they are already in their operating positions.

To achieve this object, a loudspeaker box arrangement is proposed, wherein the connecting elements are automatically adjustable as to their angle and/or length by a control unit for providing individual positional adjustment of each particular loudspeaker box. Such connecting elements make it advantageously possible to orient the loudspeaker boxes relative to one another even when they are in their operating positions. That is, after a loudspeaker box column has been fixed to a stationary suspension or a retaining device. Automatic adjustment of the connecting elements guarantees a rapid, reliable and precise positional adjustment of the orientations of the loudspeaker boxes relative to one another. With this arrangement, after complete preassembly and final assembly of the loudspeaker boxes, optimized acoustic effects can be achieved in the operating positions of the loudspeaker box arrangement. The acoustic effects can be influenced, in a substantially vertical loudspeaker box column, by the radiation characteristic of the loudspeaker box arrangement, which can be manipulated by means of the individual loudspeaker box orientations.

A control unit, in a particularly operator friendly manner, permits an appropriate, correct and reproducible automatic adjustment as to angle and/or length of the connecting elements that actively connect the respective loudspeaker boxes.

Advantageously, the control unit is a remote control unit. A remote control unit makes it possible, in a particularly operator friendly manner, even in the operating position, to provide a positional adjustment and hence an orientation relative to one another of the respective loudspeaker boxes in a loudspeaker box arrangement, for example, a substantially vertical loudspeaker box column, that is optimized in relation to its acoustic effect. An appropriate remote control unit further permits rapid and direct and empirically ascertainable verification, by personnel responsible for the control of the loudspeaker box orientation, of the acoustic improvement achieved by positional adjustments of the connecting elements. The remote control unit may be of either the cable-connection or the cable-free type.

In a preferred embodiment, the loudspeaker boxes are arranged in a row or a column. Each pair of adjacent loudspeaker boxes are actively connected at their front sides by pivot means and are connected at their rear sides by connecting elements that are adjustable as to their angle and/or length. For example, for a plurality of loudspeaker boxes that are arranged in a substantially horizontal row or in a substantially vertical column, because the angular disposition of the individual loudspeaker boxes relative to one another is important in order to improve the acoustic effect which is achievable in the operating position, it is particularly advantageous to provide pivot means at the front sides in the connecting region between two neighboring loudspeaker boxes and to provide connecting elements that are adjustable as to angle and/or length at the rear sides of the boxes. As the pivot means permit free rotation and hence angular adjustment relative to one another of the loudspeaker boxes that are actively connected to one another, the monitored and automatic control of the positional adjustment of the loudspeaker boxes is provided exclusively by the connecting elements disposed on the rear sides of the boxes because the connecting elements are adjustable as to angle and/or length. As a result, it is possible to dispose loudspeaker boxes of trapezoidal lengthwise section in bearing contact with one another at the front side of the loudspeaker box arrangement, while they are spaced apart from one another at the rear side according to the angular adjustment or orientation of the boxes. Such a loudspeaker box arrangement may thus present a closed, substantially continuous visual impression at its front side in the operating position, while gaplike interruptions are present at the rear side.

Preferably, the connecting element comprises a linear drive unit. A linear drive unit is relatively simple to control and allows precise, rapid and automatic positional adjustment or angular adjustment of loudspeaker boxes relative to one another.

Advantageously, the control unit contains setting and measurement means, which are actively connected to a control computer, for the positional adjustment and for the direct and/or indirect measurement of the positional adjustment of the loudspeaker boxes. In this case, the measurement means used may, for example, be an angle measuring device, especially in the form of an acceleration sensor, which measures an angle of gap arising in a particular case between two neighboring loudspeaker boxes and transmits a corresponding measured value to the control unit for further processing. The setting means may, for example, be an electric motor actively connected to a linear drive. The electric motor can be actively connected in a relatively simple manner to a control computer and be controlled thereby. By means of a closed control circuit between control computer, setting means and measurement means, it is possible to obtain an automatic and controlled positional adjustment of loudspeaker boxes in a loudspeaker box arrangement.

Advantageously, the active connection between the loudspeaker boxes by the connecting elements can be interrupted using a hand-operated unlocking mechanism. This makes it possible to also effect a desired positional adjustment of the loudspeaker boxes manually, if desired, for example if there is no power supply to the control unit. Secondly, it is possible to convert the loudspeaker box arrangement in a transport- and storage-friendly shape, for example a rectangular shape. The loudspeaker boxes that are actively connected to one another at their front sides by means of appropriate pivot means are rotationally moved relative to one another in a suitable manner.

In an alternate embodiment, each loudspeaker box is accommodated in a frame unit. The frame units are individually and automatically positionally adjustable relative to one another by the pivot means and the connecting elements. In this case, each frame unit may, for example, be formed as a retaining frame. The frame units may contain connecting elements, for example in the form of linear drive units, which are preassembled on the rear sides of the loudspeaker boxes. In this manner, standard loudspeaker boxes, which are traditionally accommodated in associated frame units, can be oriented automatically by positional adjustment of the frame units relative to one another within the loudspeaker box arrangement.

A method for the positional adjustment of individual loudspeaker boxes within a loudspeaker box arrangement is also proposed. The loudspeaker boxes are individually positionally adjusted by automatic adjustment of their angle and/or the length of the connecting elements. By this method, the advantages mentioned above in connection with the loudspeaker box arrangement may be achieved.

Advantageously, the loudspeaker boxes are positionally adjusted in their operating positions by a control unit. Automatic positional adjustment of the loudspeaker boxes in their operating positions, for example, when forming a substantially vertical loudspeaker box column, permits rapid, operator friendly and precise orientation of the loudspeaker boxes within the loudspeaker box arrangement with relatively low expenditure of manpower and assembly effort.

The positional adjustment of the loudspeaker boxes is preferably done by a remote control device. This ensures location independent and effective positional adjustment of the loudspeaker boxes to improve or optimize the acoustic effect achievable in the operating position of the loudspeaker box arrangement.

In a preferred alternative embodiment, for positional adjustment of the loudspeaker boxes, a desired acoustic radiation characteristic of the loudspeaker box arrangement is input into a control computer of the control unit. The control computer subsequently calculates and initiates a corresponding individual positional adjustment of the individual loudspeaker boxes. A desired acoustic radiation characteristic can be achieved in a particularly rapid and reliable manner by means of a loudspeaker box arrangement, recourse being possible to empirical values or to adapted calculation methods, e.g. in software.

Other objects and advantageous embodiments of the invention apparent from the following description of a plurality of embodiments, with reference to the accompanying drawings.

DESCRIPTION OF PREFERRED EMBODIMENTS

Figure 1:
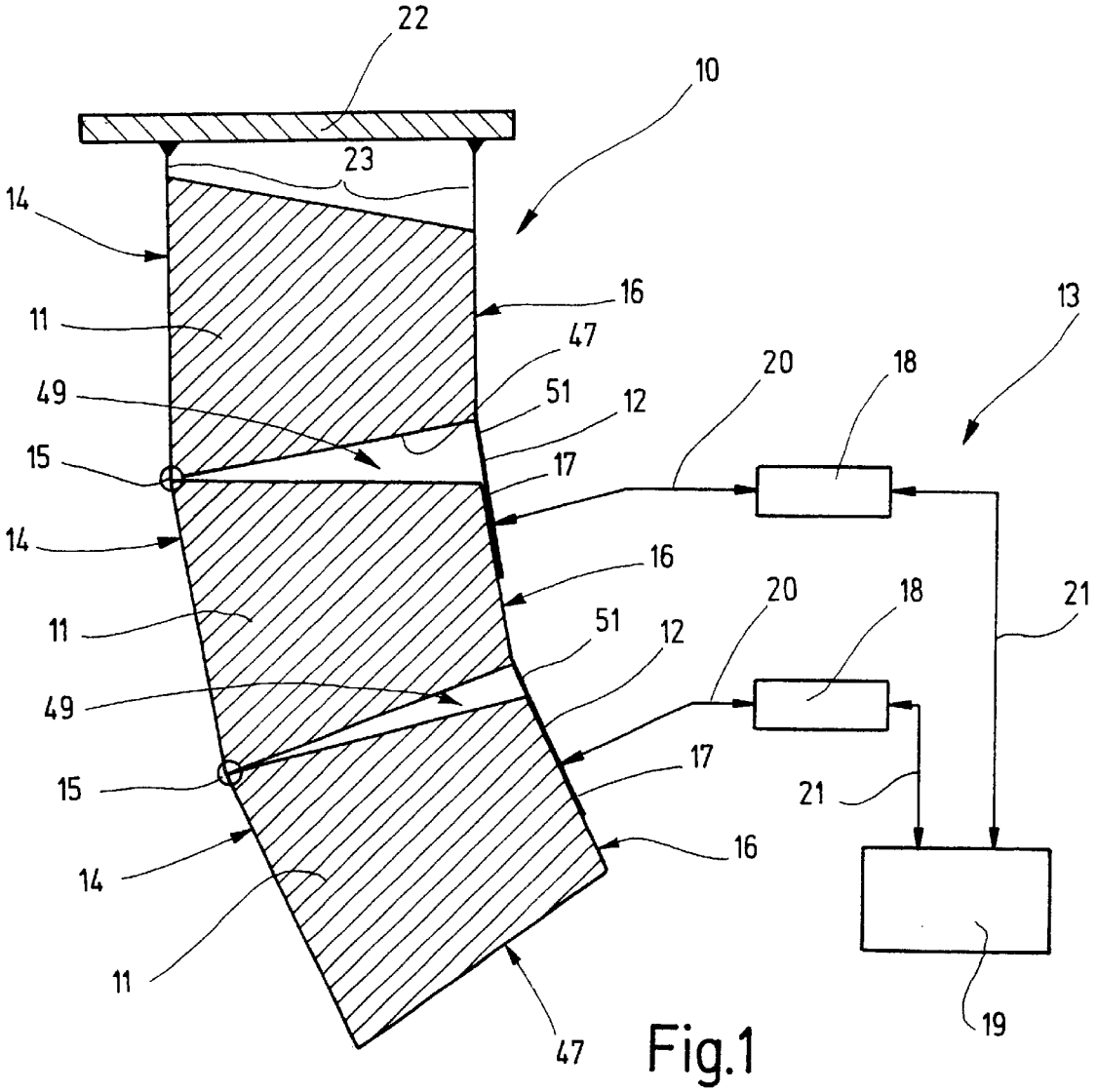
FIG. 1 is a diagrammatic, lateral, partially sectional view of a loudspeaker box arrangement according to the invention in the form of a substantially vertical loudspeaker box column.

FIG. 1 is a diagrammatic illustration a loudspeaker box arrangement 10 comprising a plurality of loudspeaker boxes 11 disposed in a substantially vertical loudspeaker box column. Fixing means 23, for example, chains or belts and corresponding hooks, fix the loudspeaker box arrangement 10 to a stationary retaining device 22. Each of the loudspeaker boxes 11 is actively connected to adjacent boxes in a positionally adjustable manner by pivots 15 at their front sides 14 and by connecting elements 12 at their rear sides 16. Each connecting element 12 is automatically adjustable as to angle between the adjacent boxes and/or length of the element by a control unit 13 enabling an individual positional adjustment of a particular loudspeaker box 11 in the operating position of the loudspeaker box arrangement 10. The control unit 13 includes a plurality of setting and measurement means 18. Each connecting element 12 is actively connected by means of a control and data transmission line, indicated by a double arrow, with an associated setting and measurement means 18. The setting and measurement means 18 are actively connected by control and data transmission lines, indicated by double arrows 21, to a central control computer 19 of the control unit 13. Each connecting element 12 is preferably a linear drive unit 17.

Figure 6:
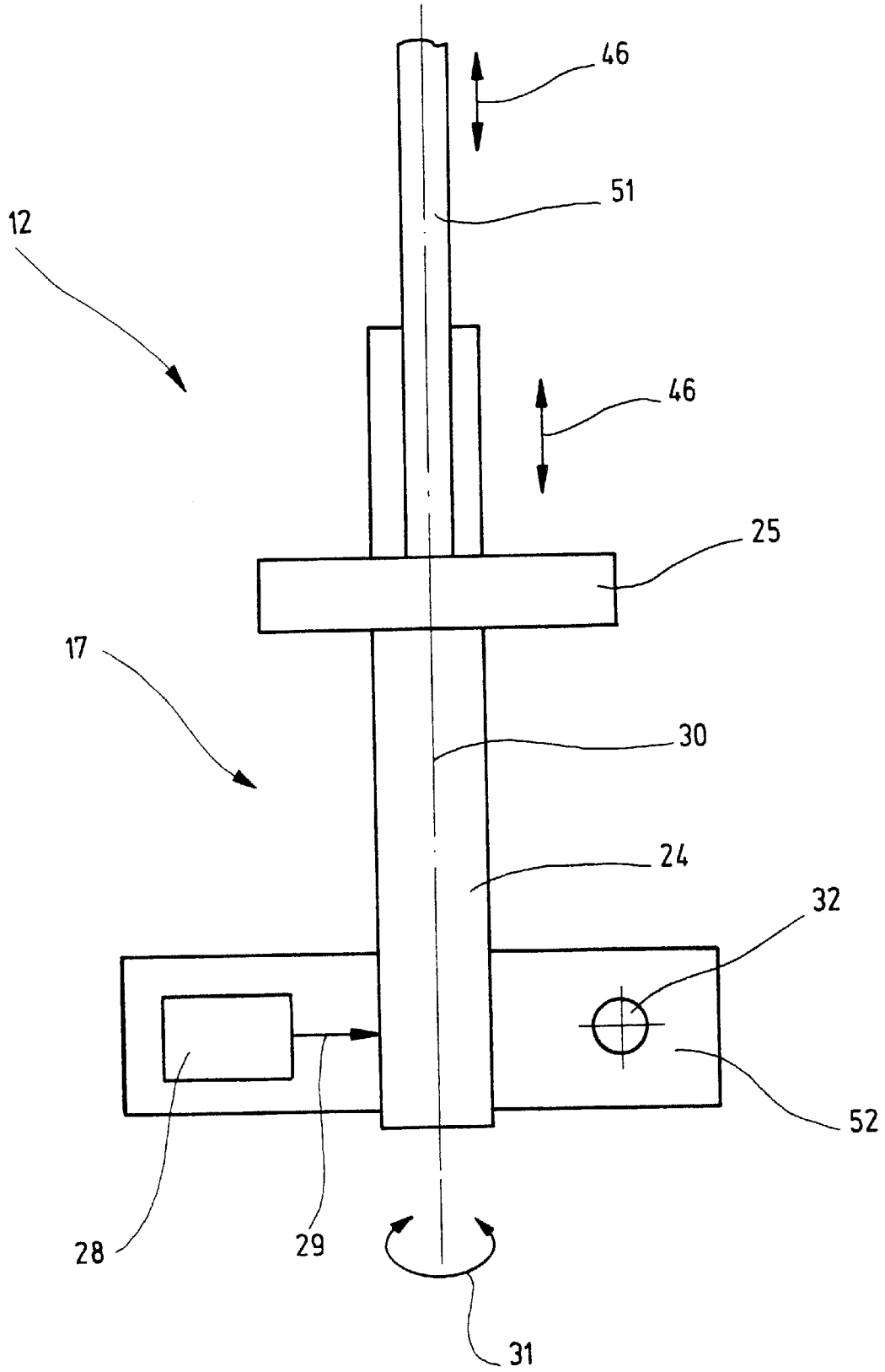
FIG. 6 is a diagrammatic illustration of a connecting element, actively connected to a drive means, here in the form of a linear drive unit.

As is diagrammatically shown in FIG. 6, each linear drive unit 17 includes a spindle 24 which can be rotated about a respective axis of rotation 30 in the directions shown by the double arrow 31 by an active drive connection, indicated by an arrow 29, with drive means 28, for example, an electric motor. The spindle 24 is operationally connected with a carriage 25, so that in the event of rotation of the spindle 24 in one direction of the double arrow 31, there is a controlled linear displacement of the carriage 25 in one respective direction shown by the double arrow 46. A setting element 51, here a rod extending coaxially with the spindle 24, is fixed on the carriage 25 to be linearly displaced along with the carriage 25. The linear drive unit 17, comprising the electric motor 28, spindle 24, carriage 25 and setting element 51, is actively connected to a retaining element 52, which includes fixing means 32 for fixing the linear drive unit 17 to a loudspeaker box 11. In this arrangement, the free, upwardly projecting end of the setting element 51 is fixed to the neighboring, upper loudspeaker box 11, so that lengthwise movement of the carriage 25 and of the setting element 51 provides a controlled relative angular adjustment of the two neighboring loudspeaker boxes 11 which are actively connected by the linear drive unit 17. The motion is about the axis of rotation of the corresponding pivot means 15. The linear drive unit 17 may also be formed as a ball screw (not shown).

Figure 2:
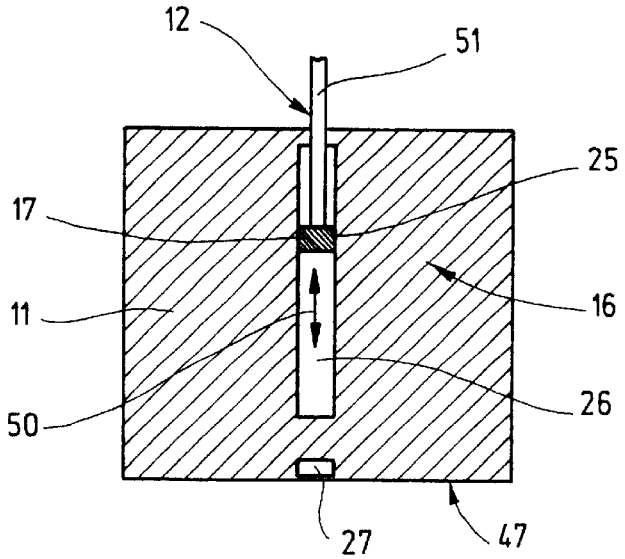
FIG. 2 is a diagrammatic, rear view on an enlarged scale of a loudspeaker box as shown in FIG. 1, not finally installed.

FIG. 2 shows a diagrammatic rear view on an enlarged scale of a loudspeaker box 11 shown in FIG. 1, but not finally installed. The loudspeaker box 11 has at its rear side 16 a recess 26 extending lengthwise, or from bottom to top, in the operating position. A guide of the carriage 25 of the linear drive unit 17 is accommodated in the recess and is displaceable lengthwise therein in the directions of the double arrow 50. Furthermore, the loudspeaker box 11 has at its rear side 16 a seating 27 that is open toward the underside 47. That enables an active connection, not shown in FIG. 2, between the loudspeaker box 11 and the free, downwardly projecting end of the setting element 51. As shown in FIGS. 1 and 2, the connecting element 12 is received at its end in a corresponding seating 27 of an upper loudspeaker box 11 and the element 12 is retained by the upper loudspeaker box 11 to produce an active connection between two neighboring loudspeaker boxes 11 at their rear sides 16. For this purpose, the spindle 24 is actively connected to the carriage 25 such that, upon rotation of the spindle 24, the carriage 25 displaces lengthwise within the recess 26 in the direction of the double arrow 50 causing an angular adjustment of the lower loudspeaker box 11 about the pivot point of an interposed pivot means 15 at the front side 14 of said loudspeaker box 11. Appropriate actuation of the connecting elements 12 and of the spindle 24 enables a desired automatic and individual orientation of a particular loudspeaker box 11 within the loudspeaker box arrangement 10. The active connection of the setting element 51 and a corresponding loudspeaker box 11 in the associated seating 27 can preferably be broken manually using an unlocking mechanism (not shown), enabling the corresponding two neighboring loudspeaker boxes 11 to be freely moved manually in rotation, for example, to position them for storage or transport.

Figure 3:
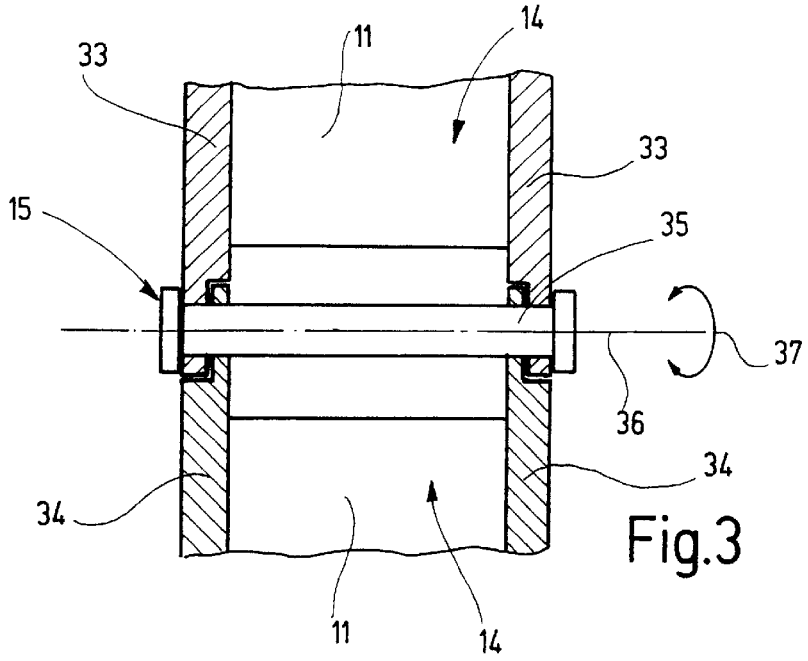
FIG. 3 is a diagrammatic, front, partial view of two pivotally connected loudspeaker boxes shown in FIG. 1, according to a first embodiment.
Figure 4:
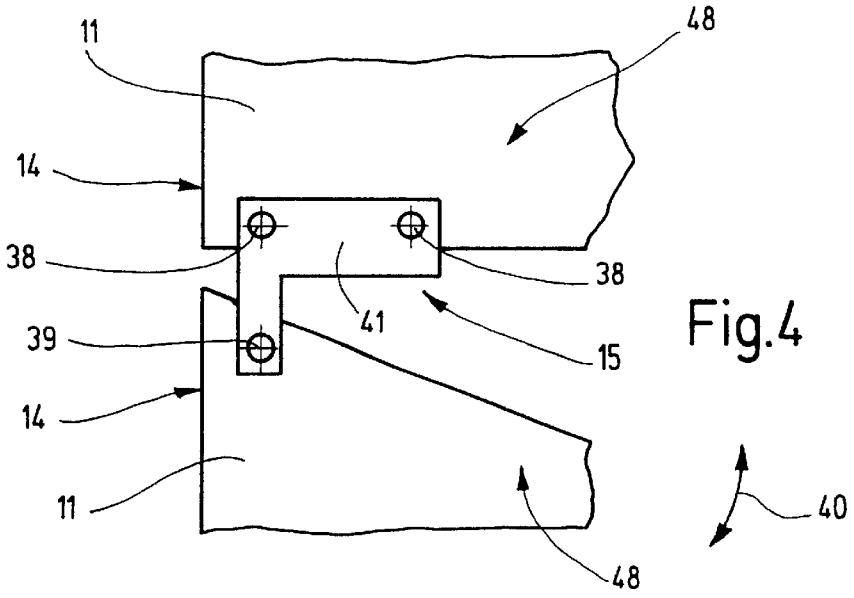
FIG. 4 is a diagrammatic, lateral, partial view of two pivotally connected loudspeaker boxes shown in FIG. 1, according to a second, alternate embodiment.
Figure 5:
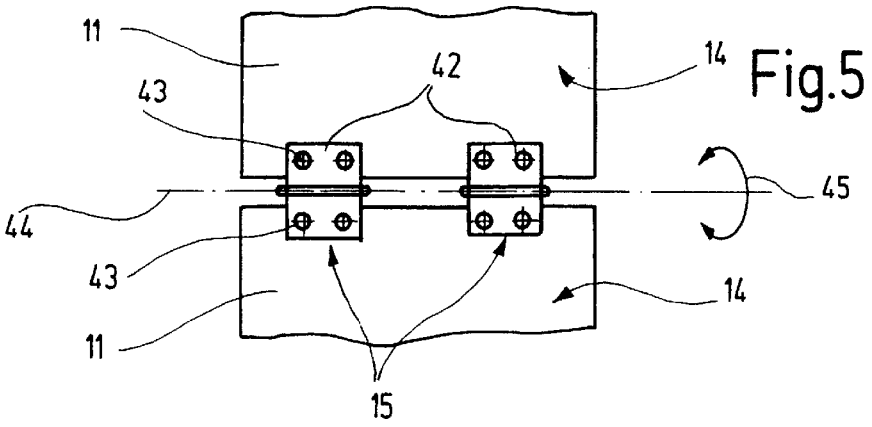
FIG. 5 is a diagrammatic, front, partial view of two pivotally connected loudspeaker boxes shown in FIG. 1, according to a third, alternate embodiment.

FIGS. 3–5 show alternative embodiments of pivot means 15 at the front side 14 of the loudspeaker box arrangement 10. In FIG. 3, two loudspeaker boxes 11 are retained by respectively assigned frame units 33, 34. The frame units 33, 34 are actively connected to one another at their ends by a fixing bolt 35 such that the respective frame unit 33 and/or 34 can be rotated or swung about an axis of rotation 36 through a selected angle in the path of the double arrow 37, together with the associated loudspeaker box 11.

In the FIG. 4 embodiment, two loudspeaker boxes 11 are actively connected to one another by a connecting mount 41 at their corresponding side walls 48. The connecting mount 41 has two fixing means 38 which provides a rotationally fixed connection of the connecting mount 41 to the upper loudspeaker box 11. Moreover, the connecting mount 41 has a further fixing means 39, which is actively connected to the lower loudspeaker box 11 to enable a rotational or pivot movement of the lower box in the direction on the path of the double arrow 40 about a pivot point of the fixing means 39.

The FIG. 5 embodiment of a pivot means 15 is at the front sides 14 of two neighboring loudspeaker boxes 11. The pivot means 15 is a hinge 42, which is fixed by suitable fixing means 43 to the respective front sides 14 of the upper and lower loudspeaker boxes 11. A central pintle permits rotational or pivot movement of one or both of the loudspeaker boxes 11 about an axis of rotation 44 (at the axis of symmetry of the pintle) on the path of the double arrow 45.

The setting and measurement means 18 in FIG. 1 contains, for example, an angle measuring device that is preferably in the form of an acceleration sensor. It measures an angle of orientation between two neighboring loudspeaker boxes 11. If the loudspeaker boxes 11 are of trapezoidal shape in lengthwise section, a tapered shape air gap 49 is formed between each pair of neighboring loudspeaker boxes 11 in an operating position shown in FIG. 1. The particular angle of orientation set between the two neighboring loudspeaker boxes 11 can be measured in the air gap in a relatively simple manner. The measured angle values are transmitted on the data transmission lines indicated by double arrows 21 to the central control computer 19. A suitable computer program (software) can calculate a corresponding individual positional adjustment of the loudspeaker boxes 11 to improve the acoustic effect in the operating position. The drive means 28 (FIG. 6), for example, an electric motor, of a setting and measurement means 18 is triggered by a control line to correspondingly adjust the associated connecting element 12 causing a desired positional adjustment or orientation of two neighboring loudspeaker boxes 11 relative to one another. A suitable computer program (software) makes it even possible for the positional adjustment of the loudspeaker boxes 11, to input a desired acoustic radiation characteristic of the loudspeaker box arrangement 10 into the control computer 19 of the control unit 13, so that the control computer 19 calculates and initiates a corresponding individual positional adjustment of the individual loudspeaker boxes 11.

It is thus advantageously possible to adjust a loudspeaker box column positionally in such a way that its front side is convex outwardly, as shown in FIG. 1, or, at the most, linear in shape, and maybe even concave. To provide a clear predictable angular arrangement of neighboring loudspeaker boxes, an initialization process may be used. All connecting elements are set to a minimum operating length, which forms a maximum angular positioning of the respectively neighboring loudspeaker boxes. Subsequently, all angular information relating to the respective loudspeaker boxes is determined by suitable measurement means. It is thus possible to assign the determined operating angles for a corresponding loudspeaker box to a loudspeaker box column. This assignment is done in such a way that the topmost loudspeaker box has the greatest positive operating angle, the neighboring lower loudspeaker box the next smaller operating angle and the bottommost loudspeaker box the smallest and even possibly negative, operating angle. In one suitable angle assignment method, the following configuration of a loudspeaker box column can be set:

| | |
|---|---|
| topmost loudspeaker box | +5° |
| second highest loudspeaker box | 0° |
| third highest loudspeaker box | −5° |
| fourth highest (bottommost) loudspeaker box | −10° |

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A loudspeaker box arrangement comprising a plurality of loudspeaker boxes arranged with individual ones of the boxes adjacent others of the boxes;

connecting elements connecting adjacent ones of the loudspeaker boxes together in a positionally adjustable manner, wherein the connecting elements are automatically adjustable as to at least one of an angle of the connecting element and length of the connecting element for adjusting the angle between adjacent boxes; and a remote control unit connected to the connecting elements between the adjacent boxes for automatically adjusting the connecting elements for adjusting the angle of the adjacent boxes with respect to each other for achieving individual positional adjustment for each of the loudspeaker boxes with respect to the other boxes in the arrangement.

2. The loudspeaker box arrangement of claim 1, wherein the loudspeaker boxes are arranged in a row or a column; each of the loudspeaker boxes has a front side and a rear side;

a respective pivot between each of the pairs of adjacent loudspeaker boxes at the front sides thereof so that adjacent ones of the loudspeaker boxes may be adjusted in their positions with respect to each other at the pivot between them; and the connecting elements that are adjustable as to angle and/or length are disposed toward the rear sides of the adjacent loudspeaker boxes.

3. The loudspeaker box arrangement of claim 2, wherein each connecting element comprises a linear drive unit extending between the adjacent boxes and drivable for adjusting the angle between the two adjacent boxes.

4. The loudspeaker box arrangement of claim 3, wherein the remote control unit is connected to the connecting elements for automatically adjusting the connecting elements for achieving the positional adjustment of the loudspeaker boxes;

the remote control unit including setting means for setting the positional adjustment of the adjacent loudspeaker boxes and means for measuring the angular positions of the adjacent boxes with respect to each other;

a control computer connected to the setting means and to the measuring means, and the computer establishing the positional adjustment of the loudspeaker boxes and for receiving the measurements of the positional adjustments of the loudspeaker boxes.

5. The loudspeaker box arrangement of claim 2, further comprising an unlocking mechanism at the connecting elements and being operable for disconnecting the connection between adjacent loudspeaker boxes by the connecting elements.

6. The loudspeaker box arrangement of claim 2, further comprising a respective frame accommodating each of the loudspeaker boxes, and the respective pivot and the connecting elements for each box are connected to the respective frame thereof.

7. A method for positionally adjusting loudspeaker boxes within a loudspeaker box arrangement wherein adjacent ones of the loudspeaker boxes within the arrangement are connected to each other by connecting elements;

the method comprising individually positionally adjusting the positions of the loudspeaker boxes, as to at least one of angle between adjacent boxes and the lengths of the connecting elements for setting positional adjustments of the boxes, by operating a remote control unit operationally connected with the connecting elements.

8. The method of claim 7, further comprising inputting a desired acoustic radiation characteristic of the loudspeaker box arrangement into a computer of the control unit for causing the control unit to control the angular orientation of the adjacent ones of the loudspeaker boxes; and operating the control computer to subsequently calculate and initiate a corresponding individual positional adjustment of the individual loudspeaker boxes to achieve the desired acoustic radiation characteristic.

* * * * *